United States Patent [19]

Dotson

[11] Patent Number: 4,726,560

[45] Date of Patent: Feb. 23, 1988

[54] CONCRETE FORM TIE ASSEMBLY

[76] Inventor: Ray C. Dotson, Rte. 3, Box 7794, Show Low, Ariz. 85901

[21] Appl. No.: 902,945

[22] Filed: Sep. 2, 1986

[51] Int. Cl.[4] ..... E04G 17/08

[52] U.S. Cl. ..... 249/43; 249/46; 249/190; 249/213; 249/217; 254/29 A; 254/104

[58] Field of Search ..... 249/13, 40, 43, 44, 249/45, 46, 183, 190, 213, 214, 216, 217; 254/29 A, 104

[56] References Cited

U.S. PATENT DOCUMENTS

| | | | |
|---|---|---|---|
| 3,181,832 | 5/1965 | Chianese | 249/43 |
| 3,437,309 | 4/1969 | Tausanovitch | 249/43 |
| 3,822,860 | 7/1974 | Lovisa et al. | 249/43 |
| 3,927,857 | 12/1975 | Lovisa et al. | 249/43 |
| 3,933,332 | 1/1976 | Lovisa et al. | 249/43 |
| 4,159,097 | 6/1979 | Strickland | 249/40 |

OTHER PUBLICATIONS

"Dayton Snap-In Ties", sales brochure, Dayton Sure--Grip and Shore Co., Dayton, Ohio, dated 2/8/39.

*Primary Examiner*—Jay H. Woo
*Assistant Examiner*—James C. Housel
*Attorney, Agent, or Firm*—Edward E. Roberts

[57] ABSTRACT

A concrete form tie assembly in which the tie rod is formed from a high tensile strength flexible wire member, with the sleeve being formed of a flexible or yieldable material. A short sleeve member is inserted into the spacer sleeve adjacent one end with washer members on opposite ends thereof for retaining on the tie rod member which is provided with spaced protrusions for coaction with the wash members, the tube and washer assembly serving to rigidify the assembly for assisting in insertion and removal of the tie rod and sleeve as a unit. The leading end of the tube and washer assembly may be provided with a conical end to act as a guide. The ends of the tie rod member are enlarged, such as by welding head members thereto, the head members being configured for coaction with conventional hairpin or snap tie wedge members.

11 Claims, 4 Drawing Figures

CONCRETE FORM TIE ASSEMBLY

BACKGROUND OF THE INVENTION

The background of the invention will be discussed in two parts.

FIELD OF THE INVENTION

This invention relates generally to the field of concrete form construction, and more particularly to a recoverable and reusable concrete form tie assembly.

DESCRIPTION OF THE PRIOR ART

In the construction of forms for pouring concrete, such as walls to be formed of concrete, forms are typically made of sheet material, such as plywood, with the two sides being formed from a plurality of aligned sheets spaced the width of the wall to be formed. Such sheets may be reinforced externally of the concrete receiving space, such as by use of cross-beams or walers. Means are provided to maintain the sheets in spaced relation, with the means having sufficient strength to withstand the pressure resulting from the added weight during pouring of the concrete. these means usually take the form of concrete ties positioned at intervals over the surface of the plywood.

For each tie, a spacing tube is positioned between aligned holes in the sheets of plywood. A rigid tie rod, such as a long bolt member is passed through the holes and the spacer with a washer and nut attached to the other end to secure the plywood sheets in spaced relation. The spacer could be, for example, a length of galvanized pipe.

After the concrete sets, the form is removed by loosening the nuts and removing the bolts, after which the plywood is stripped from the finished wall. The pipe would then remain as part of the wall.

One such apparatus is shown and described in U.S. Pat. No. 3,181,832, issued to Chianese on May 4, 1965 for "Apparatus for Preparing Concrete Foundation". In accordance with the apparatus, the spacer is a plastic member which remains in the wall. The tie rod is of a length that extends beyond the sheets of plywood and through a slot formed by spaced lateral cross-beams, the tie rod ends being enlarged and having U-shaped wedges passed thereover for abuttingly engaging the cross beams to retain the tie rod in place.

Attempts have been made to provide reusable concrete tie rod assemblies. U.S. Pat. No. 3,437,309 shows a "Reusable Concrete Form Tie", such patent being issued to Tausanovitch on Apr. 8, 1969. The spacer is a yieldable tube with a tie rod slidable therein, with a washer member or threads or the like, engageable by the tie rod on withdrawal to enable retraction of the tube after the concrete has set.

Another "Reusable Tie Assembly for Concrete Forms" is shown and described in U.S. Pat. No. 3,822,860, issued July 9, 1974 to Lovisa et al., which shows an elaborate, complex and costly mechanism which uses a yieldable elastomeric tubular sleeve with a frusto-conical cone at each end, each cone having a slotted washer embedded therein, with the tie rod having projections thereon positioned for coaction with the washers during assembly.

Another U.S. Pat. No. 3,927,857, having the same title, issued to Lovisa et al, on Dec. 23, 1975 and shows a similar tie apparatus.

A third Lovisa apparatus is shown and described in U.S. Pat. No. 3,933,332, issued Jan. 20, 1976 for "Self-Sealing Tie Assembly for Erecting Concrete Forms". The tie assembly includes an elongated tie rod on which is mounted an elongate elastomeric sleeve, with the sleeve and tie rod having interengageable surfaces for releasably coupling the sleeve to the tie rod.

U.S. Pat. No. 4,159,097, entitled "Tie Having Integrally Molded Sleeve", issued to Strickland on June 26, 1979, and discloses a tapered tie having a threaded steel rod with a longitudinally tapering protective plastic sleeve placed over the central portion thereof.

Such prior art tie assemblies utilize a spacer means in conjunction with a rigid elongate bolt like tie rod having limited flexibility. In addition, some of such assemblies require that the spacer, if removable, be driven from the concrete. In those assemblies which utilize a flexible or elastomeric removable sleeve or spacer, oftentimes the rebar or structural reinforcing steel within the form is in alignment with the openings through which the tie assemblies are inserted.

In other instances, after the tie assemblies are in position, the rebar becomes bent or dislodged during pouring. In the first instance when the rebar is partially blocking access to the tie assembly openings, the rebar must be forcefully displaced to enable insertion of the assembly. In the latter instance, with rebars of this sort bending or dislodging, they tend to apply force against the sleeve or spacer, and even bend the tie rod, thereby making it difficult to remove the tie rod, and almost impossible to remove the elastomeric sleeve intact for reuse. Other concrete form tie assemblies are unduly complicated and costly.

It is accordingly an object of the present invention to provide a new and improved concrete form tie assembly.

It is another object of the present invention to provide a new and improved concrete form tie assembly of economic, reusable construction.

SUMMARY OF THE INVENTION

The foregoing and other objects of the invention are accomplished by providing a concrete form tie assembly in which the tie rod is formed from a high tensile strength flexible wire member, with the sleeve being formed of a flexible or elastomeric yieldable material. One end of the assembly is rigidified by providing a short tube member which engages the interior of the sleeve adjacent one end of the tie rod member with washer members on opposite ends thereof for retaining on the tie rod member which is provided with spaced protrusions for coaction with the washer members.

The ends of the tie rod member are enlarged, such as by expanding the ends thereof or welding head members thereto, the head members being configured for coacting with conventional hairpin or snap tie wedge members.

Other objects, features and advantages of the invention will become apparent from a reading of the specification when taken in conjunction with the drawings, in which like reference numerals refer to like elements in the several views.

DESCRIPTION OF THE PREFERRED EMBODIMENTS

Figure 1:
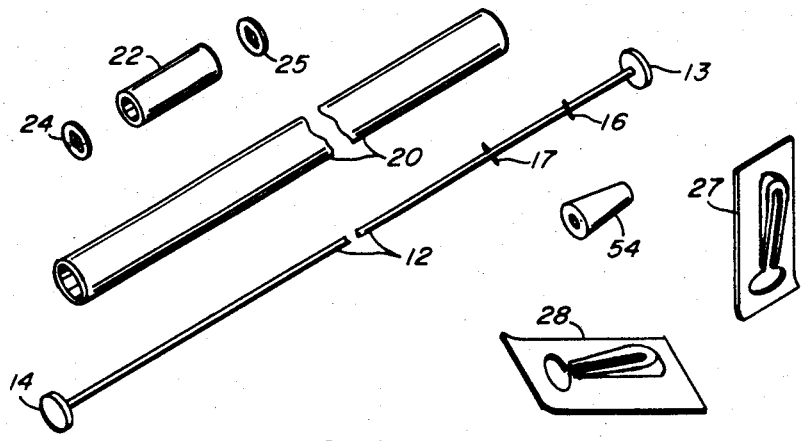
FIG. 1 is a perspective view of the components of the concrete form tie assembly according to the invention.

Referring now to the drawings, and particularly to FIG. 1, there are shown the components which go together to form the concrete tie assembly, generally designated 10, in accordance with the invention. Briefly, the assembly 10 includes a tie rod 12, formed of a high tensile strength flexible wire, for example of about one quarter inch diameter, the tie rod 12 having head members 13 and 14 at opposite ends thereof, the head members being mushroom shaped cap members which may be fixedly attached, such as by welding or swaging. The head members 13 and 14, may be approximately one-half inch in diameter. It is to be understood that the dimensions herein given are illustrative for a particular size of tie assembly 10, and are not intended to be limiting. The tie rod 12 is provided, intermediate the ends thereof, and closer to one head 13 with spaced projections or protrusions 16 and 17, which may be formed, such as by swaging, the purpose of which will be discussed hereafter.

The tie assembly 10 also includes an elongate flexible, yieldable elastomeric or vinyl sleeve 20, a shorter vinyl tube 22, a pair of washer members 24 and 25 and a pair of conventional hairpin or snap tie wedge members 27 and 28. Also included may be a plastic cone 54, having the same outer diameter as vinyl sleeve 20 and fitting between sleeve 20 and washer 25, the purpose of which is to act as a guide when inserting the tie assembly through the forms. The sleeve 20 has an internal diameter of about one-half inch and an outer diameter of about three-quarters of an inch, with tube 22 being about two inches long and having an O.D. of about one-half inch and an I.D. of about five-sixteenths of an inch. The washers 24 and 25 are about one-half inch washers with five-sixteenths of an inch apertures. The length of the tie rod 12 and the sleeve 20 will be determined by the spacing between sides of the concrete form.

Figure 2:
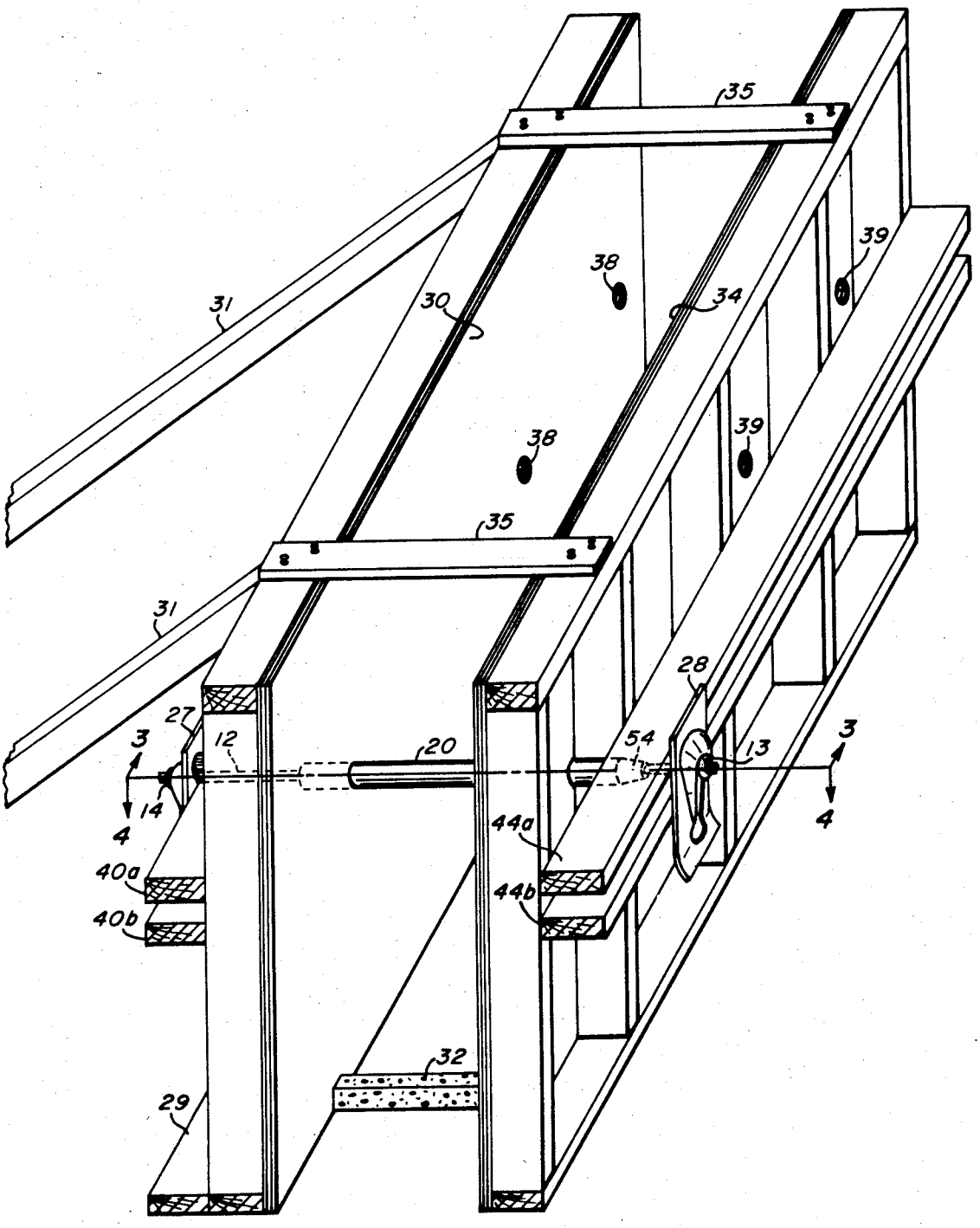
FIG. 2 is a perspective view of a concrete form utilizing the tie assembly of FIG. 1.

Referring now to FIG. 2, there is shown a concrete form, assembled in part by use of the tie assemblies 10, the form including a wood template 29 which is anchored to the slab or footing which is to support the wall, the template 29 acting as a control line. The form side 30 is erected and aligned with braces 31 extending diagonally therefrom on the outer surface to a suitable point of support, such as the ground. Concrete or metal spreaders 32 are placed against the lower edge of side 30. Side 34 is then erected with the lower edge pushed tightly against the spreaders 32, with the top edge spaced the proper width by use of wood cleats 35 nailed to the tops of the two sides 30 and 34 of the forms. It is to be understood that the sides 30 and 34 may be formed of suitably reinforced sheet material such as plywood or the like, with horizontally and vertically attached cross-beams. The sides 30 and 34 include a plurality of pre-drilled aligned pairs of openings or holes 38 and 39, the holes 38 and 39 preferably being along a given horizontal line intermediate the top and bottom edges of the sides 30 and 34. Along this horizontal line, reinforcing beams are positioned in spaced pairs on the outer surfaces of the sides 30 and 34, such as pair 40*a* and 40*b* on side 30 and pair 44*a* and 44*b* on side 34, the opposing pairs of walers or beams defining a horizontally extending gap at about the height of the aligned openings 38 and 39.

Figure 3:
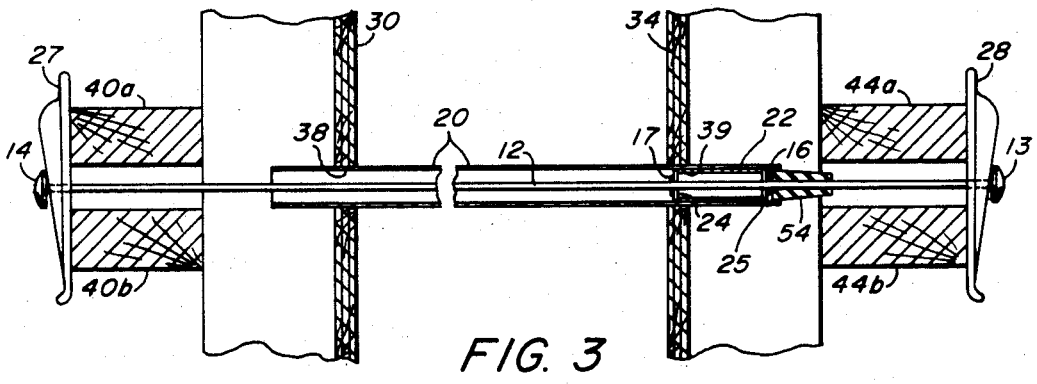
FIG. 3 is a cross-sectional view of a tie assembly within the concrete form of FIG. 2 as viewed generally along line 3—3 thereof.

FIG. 3 depicts the attachment of the tie assembly 10 in assembled relation to the form sides 30 and 34. As shown, the tie assembly 10 is affixed through each pair of aligned holes 39 and 40. For assembly and removal purposes, rigidifying means are provided at one end of the tie assembly 10. For this purpose, the small tube 22, washers 24 and 25, and cone 54 as needed, are fixedly positioned on rod 12 between protrusions 16 and 17 with the tube 22 (and cone 54 if used) intermediate the washers 24 and 25. As previously described, the washer apertures and the inner diameter of the tube 22 is about 5/16" and the rod is about ¼". The outer diameter of tube 22 is about ½", which corresponds to the outer diameter of the washers 24 and 25, and the inner diameter of sleeve 20.

The protrusions 16 and 17 are spaced apart a distance generally equal to the length of the tube 22 and the width of the two washers 24, 25, (plus plastic cone 54 if needed) the protrusions thus acting as stop means for retaining this assembly fixedly on the rod 12. The tube and washer assembly (plus cone 54 if used) thus act as a means for rigidifying one end of the tie assembly 10. The washers 24 and 25, being formed of metal act to frictionally interengage the inner surface of sleeve 20 to limit relative movement between the rod 12 and sleeve 20 after assembly, and thus assist in insertion and removal of the tie assembly 10 relative to the form.

The outer sleeve 20 is then slid over the rod 12 as well as the small tube 22 and washer 24, 25 assembly. If the cone 54 is used, sleeve 20 is slid over the rod 12, tube 22, and up to the cone. The thus partially assembled unit is then inserted into a pair of aligned holes 38 and 39, the diameters of which are slightly greater than the outer diameter of the sleeve 20, with the length of sleeve 20 being greater than the spacing between the outer surfaces of the plywood sheets of sides 30 and 34. With the assembly fed through the aligned holes 38, 39, in a direction from left to right, as viewed in FIG. 3, the lead portion of the assembly includes the rigidifying means, and the cone 54 if needed for facilitating insertion (See FIG. 4). The hairpin or wedge connectors 27, 28, are then attached to the head ends 13 and 14 of the tie rod 12 in abutting relation with the waler pairs 40 and 44, thus providing tension to the flexible tie rod 12 and maintaining the selected width or spacing of the form sides 30 and 34.

After the concrete has been poured and cured, the tie assemblies 10 may then be removed as follows. By reference to FIG. 3, the wedge connector 27 is removed, such as by tapping upwardly with a hammer, whereupon the rod 12 is tapped with a hammer on head end 14 to drive the rod 12 to the right. The wedge connector 13 may then be removed by hand, without tools, and the end 13 of the tie assembly 10 grasped, and pulled to the right. The tie rod 12 may then be withdrawn, and in most instances, with the generally rigid washers 24 and 25 frictionally engaging the interior of the sleeve 20, all or part of the sleeve 20 will be retracted at the same time. If the sleeve 20 is not totally withdrawn, it can be grasped at the end adjacent head end 13 of tie rod 12 and withdrawn the remainder of the distance from within the poured concrete.

Figure 4:
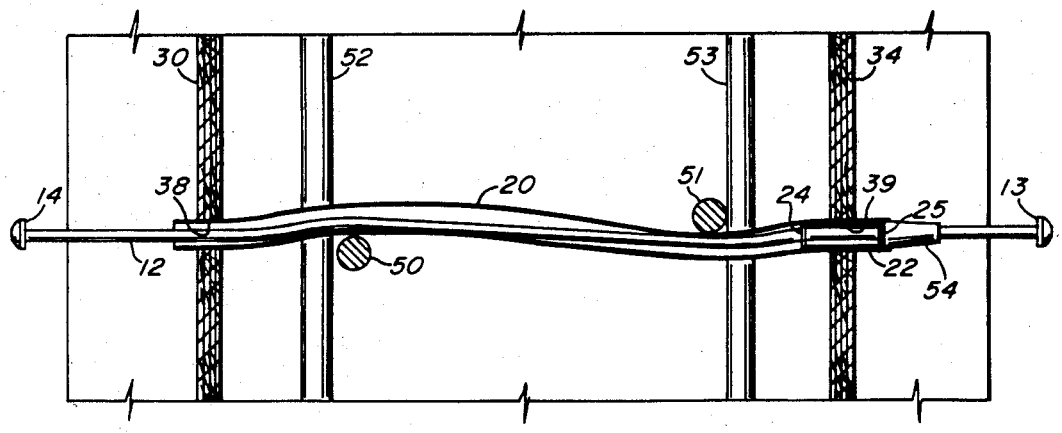
FIG. 4 is a cross-sectional plan view of a tie assembly within a concrete form, as viewed generally along line 4—4, with the tie rod flexed about structural reinforcing rods.

Referring now to FIG. 4, there is depicted a situation in which the tie assembly 10 of the present invention is superior to other reusable tie assemblies. In concrete walls, rebar or steel reinforcing rods 50–53 are disposed vertically and horizontally within the concrete receiving space between sides 30 and 34 of the form. As shown, the vertical rebar 50 and 51 are partially blocking the straight line distance between holes 38 and 39 in the sides 30 and 34 of the form. With the flexible wire tie rod 12 and the flexible sleeve 20, the assembled unit may readily be bent around the intruding rebars 50 and 51 during installation, an advantage not present with the more rigid and much larger diameter tie rods of the prior art. After the concrete has been poured and has cured, the tie rod 12 and sleeve 20 may still be withdrawn as described above, notwithstanding the somewhat serpentine path of the sleeve 20 and rod 12.

In FIG. 4, the small tube assembly is shown with conical head portion 54 which as previously described has an outer diameter equal to the outer diameter of sleeve 20, to facilitate insertion of the assembly through the aligned openings 38 and 39. Rather than using a small tube and two washers, the small tube assembly may be configured as one piece having flanged ends and a conical lead portion, with an axially extending opening for being received on rod 12, where it may be bonded or otherwise fixed in position adjacent an end of rod 12.

In accordance with the present invention, the tie assembly 10 may be readily retracted, and may be readily reused. The assembly 10 is formed of a few uncomplicated parts and utilizes conventional commercially available hairpin or wedge snap tie connectors, thus contributing to the economical nature of the device. Those skilled in the art will readily recognize that the instant invention has equal utilization to gang form (multi-form) systems utilizing conventional gang form brackets and methods wherein it is desirable to reuse forms many times, such as with abutment and retaining wall forming. Further, using the concept of the instant invention, gang form can be combined with single waler construction when for instance on a wall it is desirable to gang form one side and loose form the other side.

While there have been shown and described preferred embodiments, it is to be understood that various other adaptations and modifications may be made within the spirit and scope of the invention.

I claim:

1. The combination of a tie assembly and concrete forms, said combination comprising:

opposed concrete forms spaced a selected distance apart and having aligned pairs of openings therethrough; and a plurality of tie assemblies extending through a plurality of said aligned pairs of openings and being releasably attached to said forms, each of said tie assemblies including:

an elongate flexible high tensile strength tie rod member having means disposed at each end thereof for cooperating in releasably mounting the tie rod member in fixed position on the forms;

rigidifying means affixed adjacent one end of the tie rod member, said rigidifying means including tube means which includes a short tube member positioned and captively retained on said tie rod member;

an elongate yieldable sleeve positioned on said tie rod member between the ends thereof into interengaging relation with said rigidifying means, said sleeve being of a length greater than the selected distance between the forms, said sleeve with said tie rod member therein being inserted through an aligned pair of openings in the forms with said rigidifying means assisting in the insertion of the tie rod assembly with both ends of the sleeve and a substantial part of said rigidifying means extending beyond the outer surfaces of said forms; and said tube means being received within said sleeve adjacent one end thereof, said tube means further including metal washer means at each end of said short tube member in frictional engagement with the interior of said sleeve.

2. The combination according to claim 1 wherein said assembly further includes means attachable to the ends of said tie rod member exteriorly of the form for retaining the tie rod member in position.

3. The combination according to claim 1 wherein said tie rod member is a high tensile strength wire member.

4. The combination according to claim 1 wherein said tube means further includes a conical member nearer the adjacent end of said tie rod member.

5. The tie assembly for use in concrete pouring in a concrete receiving space between opposed concrete forms spaced a selected distance apart and having aligned pairs of openings therethrough, said tie assembly extending through an aligned pair of openings and being releasably attached to said forms, said tie assembly comprising:

an elongate flexible high tensile strength wire tie rod member having means disposed at each end thereof for cooperating in releasably mounting the tie rod member in fixed position on the forms;

rigidifying means affixed adjacent one end of the tie rod member, said rigidifying means including tube means affixed to said tie rod member, said tube means including a short tube member positioned and captively retained on said tie rod member;

an elongate yieldable sleeve positioned on said tie rod between the ends thereof into interengaging relation with said rigidifying means, said sleeve being of a length greater than the selected distance between the forms for extending therebeyond, said sleeve with said tie rod member therein being inserted through the aligned pair of openings in the forms with said rigidifying means assisting in the insertion of the tie assembly; and said tube means being received within said sleeve, said tube means further including metal washer means at each end of said short tube member.

6. The combination according to claim 5 wherein said assembly further includes means attachable to the ends of said tie rod member exteriorly of the form for retaining the tie rod member in position.

7. The combination according to claim 5 wherein said tube means further includes a conical member nearer the adjacent end of said tie rod member.

8. A tie assembly for use in concrete pouring in a concrete receiving space between opposed concrete forms spaced a selected distance apart and having aligned pairs of openings therethrough, said tie assembly extending through an aligned pair of openings and being releasably attached to said forms, said tie assembly comprising:

an elongate flexible high tensile strength tie rod member having means disposed at each end thereof for cooperating in releasably mounting the tie rod member in fixed position on the forms;

rigidifying means including tube means affixed adjacent one end of the tie rod member, said tube means including a short tube member positioned and captively retained on said tie rod member;

an elongate yieldable sleeve positioned on said tie rod between the ends thereof into interengaging relation with said rigidifying means, said sleeve being of a length greater than the selected distance between the forms for extending therebeyond, said sleeve with said tie rod member therein being inserted through the aligned pair of openings in the forms with said rigidifying means assisting in the insertion of the tie assembly; and said tube means being received within said sleeve, with said tube means further including metal washer means at each end of said short tube member.

9. The combination according to claim 8 wherein said assembly further includes means attachable to the ends of said tie rod member exteriorly of the form for retaining the tie rod member in position.

10. The combination according to claim 8 wherein said tie rod member is a high tensile strength wire member.

11. The combination according to claim 8 wherein said tube means further includes a conical member nearer the adjacent end of said tie rod member.

* * * * *